US007887359B2

(12) United States Patent
Manser

(10) Patent No.: US 7,887,359 B2
(45) Date of Patent: Feb. 15, 2011

(54) CONNECTOR COMPRISING A LOCKING DEVICE

(75) Inventor: Franz Manser, Herisau (CH)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 12/523,647

(22) PCT Filed: Nov. 12, 2007

(86) PCT No.: PCT/CH2007/000562

§ 371 (c)(1),
(2), (4) Date: Jul. 17, 2009

(87) PCT Pub. No.: WO2008/089587

PCT Pub. Date: Jul. 31, 2008

(65) Prior Publication Data

US 2010/0112844 A1 May 6, 2010

(30) Foreign Application Priority Data

Jan. 26, 2007 (CH) ..... 132/07

(51) Int. Cl.
*H01R 13/627* (2006.01)

(52) U.S. Cl. ..... 439/350

(58) Field of Classification Search ..... 439/350, 439/352, 357–358

See application file for complete search history.

(56) References Cited

U.S. PATENT DOCUMENTS

| | | | | |
|---|---|---|---|---|
| 4,801,275 | A * | 1/1989 | Ikeda et al. | 439/350 |
| 5,762,514 | A * | 6/1998 | Long et al. | 439/358 |
| 6,186,819 | B1 * | 2/2001 | Holub | 439/358 |
| 6,669,398 | B2 * | 12/2003 | Wada et al. | 403/329 |
| 6,902,420 | B2 * | 6/2005 | Muro et al. | 439/358 |
| 7,056,142 | B2 * | 6/2006 | Ueda | 439/358 |
| 2006/0079110 | A1 | 4/2006 | Ichida et al. | |

FOREIGN PATENT DOCUMENTS

| | | |
|---|---|---|
| DE | 29921254 | 4/2001 |
| DE | 10109179 | 9/2002 |
| DE | 10339965 | 4/2005 |
| DE | 102004041809 | 4/2005 |
| WO | 0104995 | 1/2001 |

* cited by examiner

*Primary Examiner*—Jean F Duverne
(74) *Attorney, Agent, or Firm*—The Webb Law Firm

(57) ABSTRACT

A connector includes a housing, which extends along a longitudinal axis lying in the plug-in direction and which is divided into an electric connector part and a locking device located next to the electric connector part for the releasable locking of the connector with a corresponding counterpart. The locking device includes a detent bracket that is held in a receiving chamber of the housing, that extends in the plug-in direction, and can be elastically deflected perpendicularly to the plug-in direction. The detent bracket is elastically deflected perpendicularly to the plug-in direction by an actuating element mounted on the housing in order to be disengaged. A compact construction is achieved because the actuating element lies adjacent to the detent bracket perpendicularly to the plug-in direction and the length of the actuating element in the plug-in direction is less than or approximately equal to the length of the detent bracket.

9 Claims, 3 Drawing Sheets

CONNECTOR COMPRISING A LOCKING DEVICE

BACKGROUND OF THE INVENTION

1. Field of the Invention

The present application relates to the field of electrical connectors, and more particularly to a connector having a locking device.

2. Description of Related Art

In the automotive industry, RF systems (GPS, external aerials for mobile radio, car radio etc.) are being increasingly integrated in the vehicles, and coaxial cables have to be laid and connected in the vehicle for these RF systems. Standards have been introduced in the USA and in Europe for such coaxial automotive connectors in order to make systems from different manufacturers compatible with one another. The existing standard in the USA is SAE/USCAR-18, and this corresponds to DIN standard 72594-1 (FAKRA) in Europe. The international standard is ISO-20860-1.

In this connection, the applicant already provides automobile connectors which are covered under the term ARC (Automotive Radiofrequency Connectors) and which have been developed as RF connector families specifically for telematics, multimedia, safety and security applications in automobiles and heavy goods vehicles.

This family includes angular connectors in which the coaxial cable to be connected is generally inserted into the connector such that it is bent back through 90° with respect to the plugging direction or plug axis. Angular connectors of this type for the automotive sector are disclosed, for example in DE-A1-10 2004 041 809 or DE-B3-103 39 965.

In order to secure an inserted plug connection, said connectors have a locking mechanism which latches in during insertion and can be unlatched again only by operating an operating element provided for this purpose. A locking mechanism of this type is described, for example, in the abovementioned document DE-A1-10 2004 041 809.

One disadvantage of the known locking mechanisms is that they lead to a relatively large overall length of the housing and are composed of a plurality of separate parts which have to be produced individually and then have to be assembled with a considerable amount of outlay. Furthermore, the known solutions are sensitive to external influences.

SUMMARY OF THE INVENTION

It is therefore an object of the invention to provide a connector comprising a locking mechanism which avoids the disadvantages of known solutions and is distinguished in particular by simplified construction and mounting, a high degree of robustness and a very short overall length of the housing and can be used within the plug connections which are standard for the automotive sector.

The object is achieved by all the features of claim 1. In the connector according to the invention, the locking device comprises a latching clip which is accommodated in an accommodation space in the housing, extends in the insertion direction and can be elastically deflected transverse to the insertion direction, it being possible for said latching clip to be elastically deflected transverse to the insertion direction for unlatching purposes by means of an operating element which is mounted on the housing. It is essential that the operating element is arranged next to the latching clip transverse to the insertion direction, and that the length of the operating element is smaller than or approximately equal to the length of the latching clip in the insertion direction. This allows a very compact and short housing which can be produced and mounted in a simple manner.

One refinement of the invention is characterized in that the latching clip is fixed to the housing by means of arms which extend in the insertion direction and can be elastically deflected transverse to the insertion direction, and in that the operating element engages with the latching clip by means of a rocker in such a way that, when the rocker is pressed down by the operating element on one side of the rocker, the latching clip is elastically deflected transverse to the insertion direction on the other side of the rocker.

The rocker is preferably formed by two parallel rocker arms which extend in the insertion direction and are supported on a floor of the accommodation space which runs parallel to the insertion direction by means of bearing lugs which are integrally formed in the central region.

Another refinement is distinguished in that the accommodation space is bounded on that side which is opposite the floor by a ceiling which runs parallel to the floor and at the same time forms an outer wall of the housing, and in that a tongue which can be elastically deflected transverse to the insertion direction is formed in the ceiling as the operating element, wherein two edge slots are provided in the ceiling in order to form the operating element, said slots running in the insertion direction and extending from the rear end of the ceiling far into the ceiling.

A preferred development of the invention is characterized in that the arms of the latching clip are arranged between the rocker arms, and in that the latching clip, by way of its arms, the rocker arms and the operating element are integrally formed on the housing and are part of an integral plastic housing, preferably formed by means of injection molding.

The housing and the accommodation space have, in particular, a substantially rectangular cross section.

The connector is preferably a coaxial connector which is provided, in particular, for use in the automotive sector. In this case, said connector may be an angular plug.

BRIEF DESCRIPTION OF THE FIGURES

The invention will be explained in greater detail below with reference to exemplary embodiments in conjunction with the drawing, in which.

DETAILED DESCRIPTION OF THE PRESENT INVENTION

Figure 1:
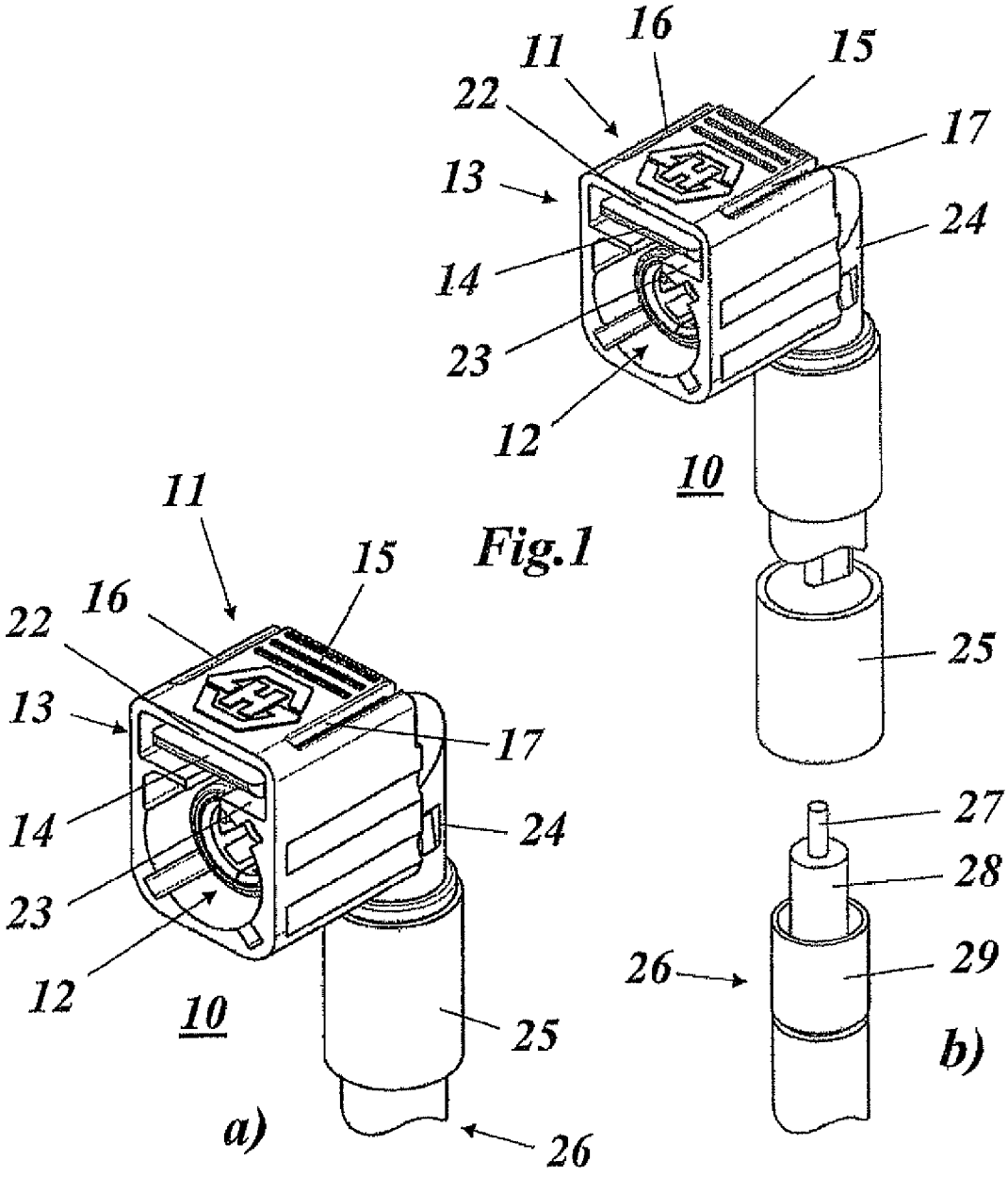
FIG. 1 shows, in two perspective illustrations (1*a* and 1*b*), a connector according to one exemplary embodiment of the invention in the form of a coaxial angular plug.
Figure 2:
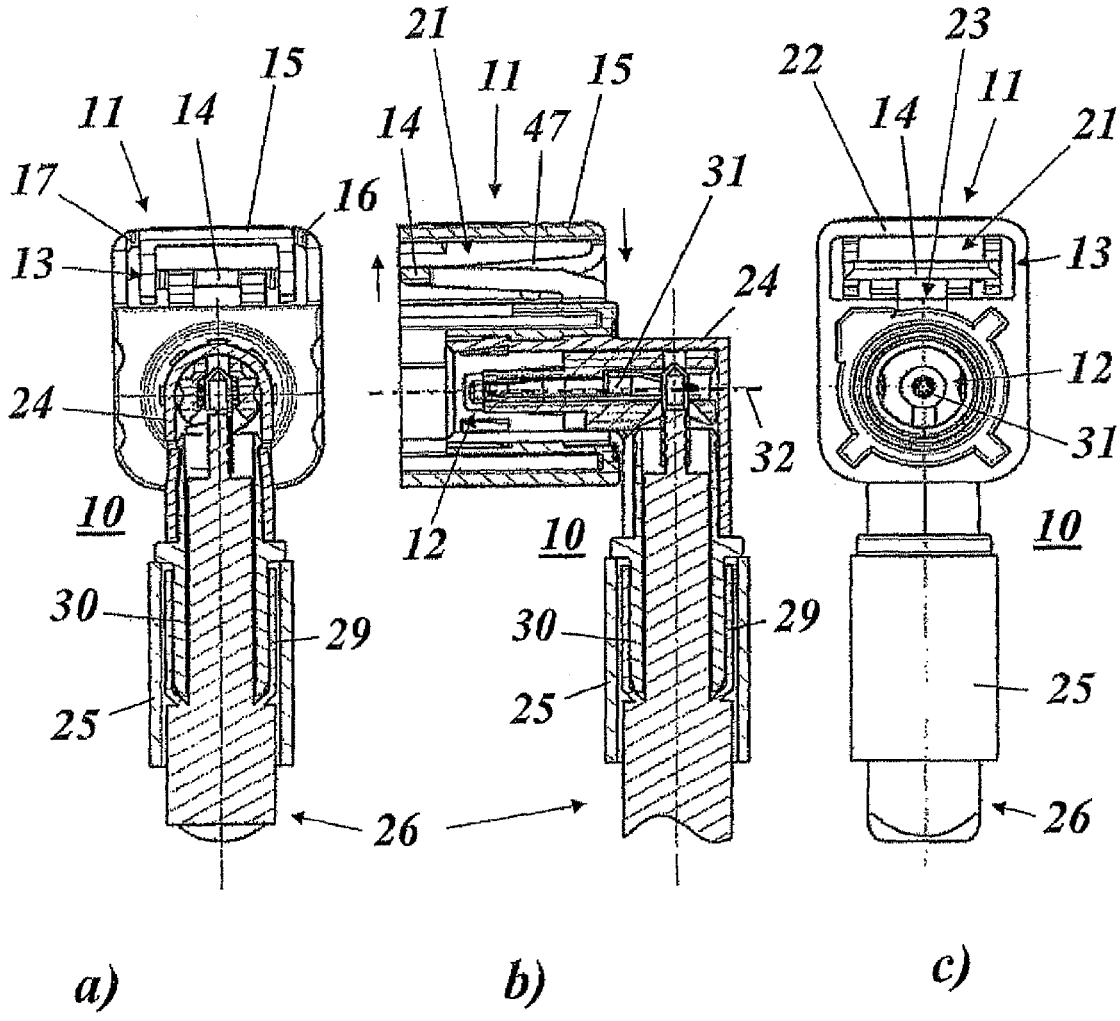
FIG. 2 shows, in two section views (2*a* and 2*b*) and one side view (2*c*), the angled connector from FIG. 1 with a connected coaxial cable.

FIGS. 1 and 2 show various section and side views of an angled connector according to a preferred exemplary embodiment of the invention. The connector 10 preferably serves for releasably connecting coaxial cables 26 in the automotive sector in order to couple signals up to frequencies in the GHz range into existing electronic devices (radio, mobile radio, GPS etc.) or to couple them out of said devices.

In this case, the connector 10 meets an international standard and can be encoded in order to avoid incorrect connections.

Figure 3:
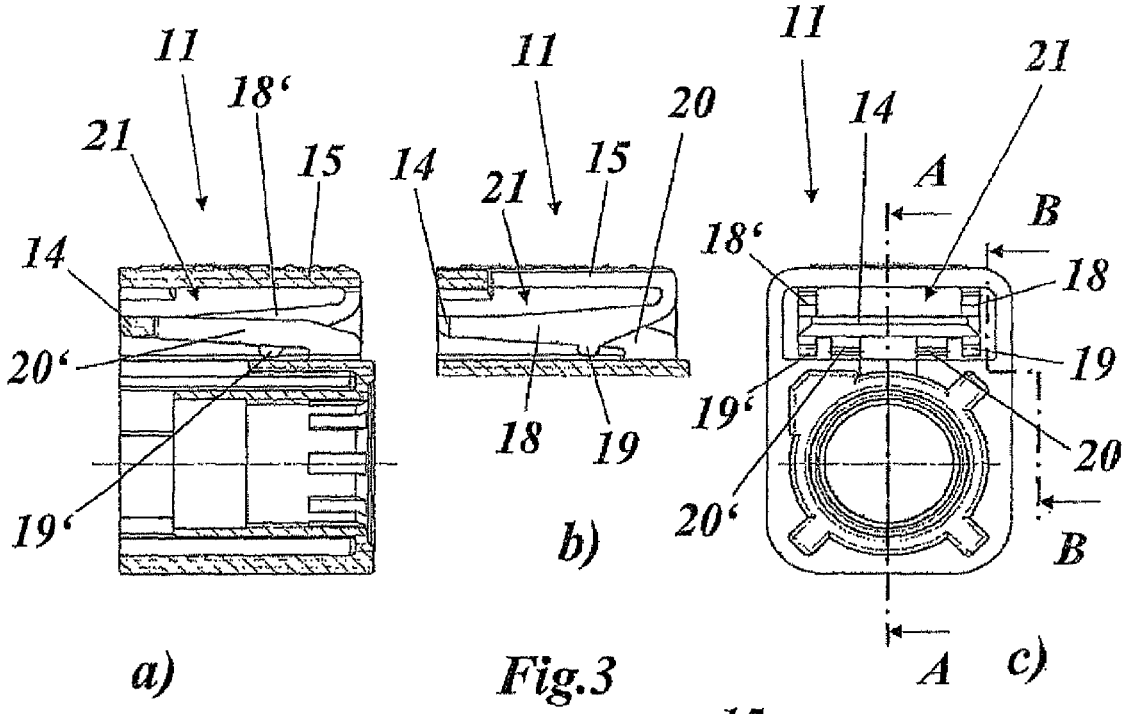
FIG. 3 shows two section views (3*a* and 3*b*), in section planes A-A and B-B from FIG. 3*c*, and one side view (3*c*) of the housing of the connector from FIG. 1.
Figure 4:
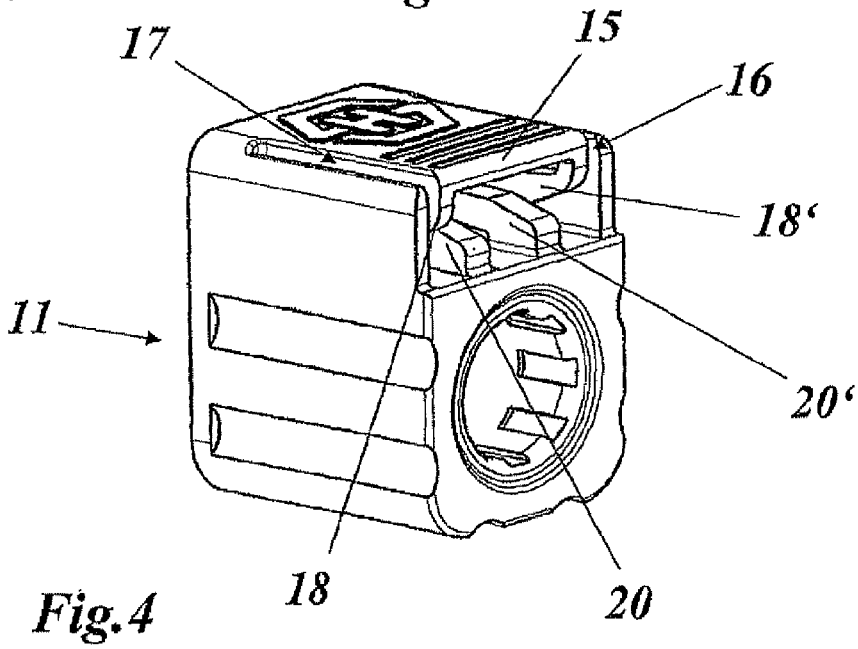
FIG. 4 shows a perspective rear view of the housing from FIG. 3.

The connector 10 comprises a plastic housing 11 with a substantially rectangular cross-sectional profile. The housing 11, which itself is illustrated in FIGS. 3 and 4, has, in the lower region, an electrical connection part 12 in the form of a largely cylindrical passage opening with which it is pushed and snapped onto a (in FIG. 2*b* horizontal) cylindrical portion of a right-angled external conductor 24.

A manually operated (releasable) locking device 13 is integrated in an accommodation space 21 in the housing 11, which is open on both sides, above the electrical connection part 12, said locking device interacting with a hook-like element on the mating piece (not illustrated in the figures) of the connector 10. The accommodation space 21 has a substantially rectangular cross section and is bounded at the bottom (in the direction of the electrical connection part 12) by a floor 23 which runs in the insertion direction. At the top, the accommodation space 21 is bounded by a ceiling 22 which is parallel to the floor and at the same time forms an outer wall of the housing 11.

The locking device 13 comprises a latching clip 14 which lies in the accommodation space 21 parallel to the insertion direction (longitudinal axis 32 in FIG. 2*b*), can be elastically pivoted transverse to the insertion direction (away from the floor 23) and has a front part which lies transverse to the insertion direction and terminates flush with the accommodation space 21 at the front. Two parallel arms 20 and 20' run toward the rear from the transverse front part of the latching clip 14 in the insertion direction and are fixed to (integrally formed on) the floor 23 of the accommodation space 21 by way of their rear end. The transverse front part of the latching clip 14 connects the free ends of the arms 20, 20' to one another and, on account of the elasticity of the arms 20, 20', can be deflected transverse to the insertion direction. The transverse front part of the latching clip 14 is rounded at the lower front edge and therefore, when the connector 10 is inserted into its mating piece, can slide on the front incline of the hook-like element and latch in on the projection which is situated behind it. In this case, the latching clip 14 is bent upward transverse to the insertion direction and snaps back into its inoperative position when said front part latches in.

In order to release the latching of the plug connection again, the latching clip 14 has to be pivoted upward again, so that it can slide back over the hook-like element during disconnection. This is performed by means of an operating element 15 which is integrated in the ceiling 22 and can be pressed elastically downward into the accommodation space 21 in the manner of a spring tongue. In order to form the operating element 15, two edge slots 16, 17 which run in the insertion direction 32 are provided in the ceiling 22, said slots extending from the rear end of the ceiling 22 far into the ceiling 22.

The operating element 15 engages with the latching clip 14 by means of a rocker 18, 18' in such a way that (as indicated by the two directional arrows in FIG. 2*b*), when the rocker 18, 18' is pressed down by the operating element 15 on one side of the rocker 18, 18', the latching clip 14 is elastically deflected transverse to the insertion direction on the other side of the rocker 18, 18'. The rocker is formed by two parallel rocker arms 18, 18' which extend in the insertion direction and are supported on the floor 23 of the accommodation space 21 by means of bearing lugs 19, 19' which are integrally formed on the lower face in the central region.

As can be seen in FIGS. 3*c* and 4 in particular, the arms 20, 20' of the latching clip 14 are arranged between the rocker arms 18, 18'. The two pairs of arms 18, 18' and 20, 20' have the same overall length and end within the accommodation space 21 without protruding at the ends. Together with the operating element 15 integrated in the ceiling 22, the result is an extraordinarily short and compact locking mechanism which permits a very short housing and is largely protected against damage and soiling. By virtue of the positioning of the bearing point of the rocker 18, 18', that is to say the positioning of the bearing lugs 19, 19', in the longitudinal axis, the lever ratios (lever force/lever travel) can be changed and matched to requirements.

The configuration of the locking device 13 illustrated in the figures allows, in particular, the latching clip 14, by way of its arms 20, 20', the rocker arms 18, 18' and the operating element 15 to be directly integrally formed on the housing 11. Said elements are then part of an integral, plastic housing 11, preferably formed by means of injection molding.

In order to produce a plug connection to a coaxial cable 26, the housing 11 according to FIG. 2 is snapped onto an (angled) external conductor 24 in which an internal conductor 31 is arranged in an insulated manner. This internal conductor 31 is connected to the internal conductor 27 of the coaxial cable 26 by means of a plug connection. The external conductor 24 of the connector 10 is connected to the external conductor 29 of the coaxial cable 26 by means of a transition piece 30, said external conductor 29 being fixed on the transition piece 30 by means of a pressing sleeve 25. The dielectric 28 which is located between the internal conductor 27 and the external conductor 29 of the coaxial cable 26 is inserted far into the transition piece 30.

The invention claimed is:

1. A connector comprising:

a housing which extends along a longitudinal axis, lies in an insertion direction, and is divided into an electrical connection part; and a locking device, which is arranged next to the electrical connection part, for releasably locking the connector to a corresponding mating piece, wherein the locking device comprises:

a latching clip which is accommodated in an accommodation space in the housing, extends in the insertion direction and is configured to be elastically deflected transverse to the insertion direction; and an operating element mounted on the housing and configured to elastically deflect the latching clip transverse to the insertion direction for unlatching purposes, wherein the operating element is arranged next to the latching clip, transverse to the insertion direction, and in that a length of the operating element is one of smaller than or approximately equal to the length of the latching clip in the insertion direction, and the latching clip is fixed to the housing by arms which extend in the insertion direction and are configured to be elastically deflected transverse to the insertion direction, and the operating element engages with the latching clip by a rocker in such a way that, when the rocker is pressed down by the operating element on one side of the rocker, the latching clip is elastically deflected transverse to the insertion direction on another side of the rocker.

2. The connector as claimed in claim 1, wherein the rocker is formed by two parallel rocker arms which extend in the insertion direction and are supported on a floor of the accommodation space which runs parallel to the insertion direction by bearing lugs which are integrally formed in a central region.

3. The connector as claimed in claim 2, wherein the accommodation space is bounded on a side which is opposite the floor by a ceiling which runs parallel to the floor and at the same time forms an outer wall of the housing, and a tongue, which can be elastically deflected transverse to the insertion direction, is formed in the ceiling as the operating element.

4. The connector as claimed in claim 3, wherein two edge slots are provided in the ceiling in order to form the operating element, the slots running in the insertion direction and extending from a rear end of the ceiling far into the ceiling.

5. The connector as claimed in claim 2, wherein the arms of the latching clip are arranged between the rocker arms, and the latching clip, by way of its arms, the rocker arms, and the operating element are integrally formed on the housing and are part of an integral plastic housing.

6. The connector as claimed in claim 1, wherein the housing and the accommodation space have a substantially rectangular cross section.

7. The connector as claimed in claim 1, wherein the connector is a coaxial connector.

8. The connector as claimed in claim 7, wherein the connector is an angular plug.

9. The connector as claimed in claim 5, wherein the latching clip, by way of its arms, the rocker arms, and the operating element are integrally formed on the housing by means of injection molding.

* * * * *